US005243946A

United States Patent [19]

Dalupan

[11] Patent Number: 5,243,946

[45] Date of Patent: Sep. 14, 1993

[54] APPARATUS FOR THE MAGNETIC TREATMENT OF FUEL

[75] Inventor: Romulo V. Dalupan, Walcott, Iowa

[73] Assignee: Gekko International, L.C., Davenport, Iowa

[21] Appl. No.: 986,585

[22] Filed: Dec. 7, 1992

[51] Int. Cl.[5] ..... F02M 33/00

[52] U.S. Cl. ..... 123/538; 123/536

[58] Field of Search ..... 123/536, 537, 538

[56] References Cited

U.S. PATENT DOCUMENTS

| | | | |
|---|---|---|---|
| 3,228,868 | 1/1966 | Ruskin | 123/536 |
| 3,349,354 | 10/1967 | Miyata | 123/538 |
| 4,414,951 | 11/1983 | Saneto | 123/536 |
| 4,611,615 | 9/1986 | Petrovic | 123/538 |
| 4,808,306 | 2/1989 | Mitchell et al. | 123/538 |
| 5,055,188 | 10/1991 | Johnston et al. | 123/538 |
| 5,076,246 | 12/1991 | Onyszczuk | 123/536 |
| 5,127,385 | 7/1992 | Dalupin | 123/537 |

FOREIGN PATENT DOCUMENTS

| | | | |
|---|---|---|---|
| 1092917 | 1/1981 | Canada | 123/538 |

*Primary Examiner*—Willis R. Wolfe
*Assistant Examiner*—M. Macy
*Attorney, Agent, or Firm*—Dick and Harris

[57] ABSTRACT

An apparatus for the magnetic treatment of fuel for an internal combustion engine, for separating fuel impurities from the fuel molecules, including a conduit which passes through a plurality of magnetic pack means. Each magnetic pack means exposes the passing fuel to a net positive magnetic field influence. Each magnetic pack means is formed from a number of magnets having alternately oriented poles, arranged along one side of the conduit, with reflectors extending perpendicular to the conduit, positioned between the magnets. Further reflectors are positioned within the conduit, substantially in alignment with the magnetic pack means.

15 Claims, 1 Drawing Sheet

25
10
24
4
14
11
26
15
18
23
17
12
21
22

37
34
33
40
36
35
32
43
31
45
46
42
30
29
44
41
28
27

71
57
70
56
69
55
68
65
54
64
67
63
53
62
61
50
66
52
20
51
21

5
16
29
30
15
61
67
66
12
19
5

16
15
27
28
29
30
31
15
32
35
36
33
37
34
52
67
46
46
17
A
12

APPARATUS FOR THE MAGNETIC TREATMENT OF FUEL

BACKGROUND OF THE INVENTION

The present invention relates to apparatus for treating fuel for an internal combustion engine, toward the improvement of combustion efficiency for improved mileage and reduction in pollutants created by the combustion process. In particular, the present invention is directed to an apparatus for magnetically treating fuel in a gasoline-powered internal combustion engine.

Apparatus for the magnetic treatment of fuel in an internal combustion engine are known. For example, an apparatus for the magnetic treatment of diesel fuel is disclosed in Canadian Patent No. 1,092,917, issued to Dalupan. In the Canadian '917 patent, first magnet means are provided for first exposing the fuel to a positive, and then negative, magnetic influence, in order to promote the separation of various particulate material, such as mineral particles, dirt and heavy oil-based matter which becomes weakly bonded to the actual hydrocarbon fuel molecules in the diesel fuel. After the fuel has been exposed to the positive and then negative magnetic influence, it is then again exposed to a negative magnetic influence, the effect of which is to promote the actual physical expansion of the hydrocarbon fuel molecules. In so doing, the diesel fuel molecules are thus made more receptive to more complete combustion. In the process of polarization of the particulate materials from the fuel molecules, the particulate materials also become polarized with respect to the fuel conduits and the interior surfaces of the combustion chambers, so that during the combustion process, less of the particulates will stick to the cylinder surfaces. In addition, the particulate materials, being separated from the fuel molecules, while interfering less with the combustion process, are also burned themselves to a small degree, leading to a reduction in the particulate emissions from the engine as well.

In the Canadian '917 apparatus, the first region of positive, then negative magnetic influence is created by the placement of a magnetic member against the conduit through which the fuel passes, with the north pole of the magnet facing upstream and the south pole of the magnet facing downstream. Magnetic reflector structures are positioned against the poles of the magnetic member to help focus the magnetic flux as closely as possible to the fuel flow. The reflectors adjacent the magnet are actually embedded within the pipe so that the tips of the reflectors are actually in the fuel flow. A further reflector member is positioned on the outside of the pipe diametrically opposite the magnet. These reflectors help continue the flow of the magnetic field from the north pole through the south pole. Further downstream, a series of donut- or ring-shaped magnets having their north poles on their upstream faces and their south poles on their downstream faces are arranged together in immediately abutting position. A single conical reflector is then positioned immediately adjacent to the south pole of the most downstream positioned ring shaped magnet. The reflector, formed of ferromagnetic material, directs a portion of the magnetic field emanating from the south pole of the furthest downstream magnet along the direction of the fuel flow which tends to impose a net negative magnetic influence upon the fuel. Such a negative magnetic influence has been perceived to cause the physical expansion or swelling, of the large hydrocarbon molecules comprising diesel fuel.

In an attempt to provide for a more effective exposure of the fuel, passing through the conduit, to the influence of the magnetic fields, a different configuration for the magnetic members is desired. An improved magnetic member configuration is shown in U.S. Pat. No. 5,127,385 to Dalupin (sic). In the apparatus of Dalupin '385, which is also primarily directed to applications in the treatment of diesel fuel, a first region of magnetic influence is provided by placing a pair of magnetic packs upon diametrically opposed sides of a fuel conduit.

One magnetic pack comprises three magnetic members arranged in succession along one side of the fuel line. Two reflectors separate the three magnetic members. The most upstream of the three magnetic members has its south pole on the upstream side and its north pole on the downstream side. The middle magnet has its north pole on the upstream side and its south pole on the downstream side. The most downstream of three magnetic members has its south pole on the upstream side and its north pole on the downstream side, the same orientation as the furthest upstream magnetic member. With this configuration, the reflectors positioned between the magnets have edges embracing the fuel conduit, which are formed into north and south magnetic poles, proceeding from upstream to downstream, respectively. Upon the diametrically opposed side of the fuel conduit, a similar group of three magnetic members and two reflectors is positioned. However, the respective poles of the magnetic members are reversed relative to their corresponding counterparts on the opposite side of the conduit. Accordingly, the upstream reflector edge will have a south pole imposed upon it while the downstream reflector edge will have a north pole imposed on it. In order to further focus the magnetic field flow through the fuel, reflector members are provided which are press-fitted into the fuel conduit. Each reflector member is an elongated member having two opposed concave faces, each concave face directed toward one of the diametrically opposed magnetic packs. As in the Canadian '917 patent, the section of the fuel treatment apparatus which is devoted to the expansion of the fuel molecules by the imposition of a predominately negative magnetic influence is again formed by a number of packs, each one of which is substantially formed similarly to the "expander" section of the Canadian '917 device. In particular, each magnetic pack is composed of one or more ring-shaped magnets which encircle the fuel conduit. With respect to each ring-shaped magnet, the north pole is upstream and the south pole is always downstream. Positioned immediately downstream and adjacent to the ring-shaped magnets is a conical collector which directs the flow of the magnetic field emanating from the immediately adjacent magnetic south pole along the direction of fluid flow to imposed upon the fuel, a substantially negative magnetic influence leading to the physical expansion of the hydrocarbon molecules within the fuel.

While each of the foregoing apparatus are capable of functioning to some degree with the lighter molecule, gasoline-type fuels, each of the preceding described devices is primarily directed to diesel-type fuels which have substantially larger, and heavier molecules, for which the expansion provided by the region of negative magnetic influence is more beneficial. Further, diesel fuel and similar fuels are less refined than lighter fuels like gasoline, and therefore have much higher percentages of paramagnetic impurities, like minerals, dirt, carbon particulates, and the like.

It is presently believed that the application of negative magnetic influence to diesel fuel had an additional effect, other than to accomplish the physical expansion of the diesel fuel molecules. It is believed that it is desirable to have a negative charge present when the combustion ingredients, hydrocarbon fuel and oxygen (air) are brought together. Accordingly, in the prior devices, the exposure of the diesel fuel to the negative magnetic influence, by imparting such a negative charge to the fuel fluid, enhances the combustibility of the fuel. In the environment of spark-ignition engines, which almost exclusively use gasoline-type fuels, it is now believed to be unnecessary to impart negative charge to the fuel, as the necessary negative charge is supplied by the ignition spark, which is absent in a diesel-powered engine.

It is believed that lighter, gasoline-type fuels tend to respond to magnetic influence in a somewhat different manner than diesel-type fuels, due to the different chemical composition, of the fuels, as well as the character of the different impurities. For example, gasoline and similar fuels have a much higher percentage of water than do diesel fuels. These water molecules can become weakly bonded to the gasoline hydrocarbon fuel molecules, and can thus impede the combustion process.

Accordingly, it is an object of the present invention to provide an apparatus for the magnetic treatment of fuel, in particular, gasoline-type fuel for internal combustion engines.

It is further object of the invention to provide a apparatus for the magnetic treatment of gasoline-type fuels which has a still further improved means for exposing the fuel to the magnetic influence for an improved treatment of the fuel.

Yet another object of the invention is to provide an apparatus for the magnetic treatment of gasoline fuel which will be effective in accomplishing the unbonding of water molecules from the hydrocarbon molecules.

These and other objects of the invention will become apparent in light of the present specification, claims and drawings.

SUMMARY OF THE INVENTION

The present invention is an apparatus for the magnetic treatment of fuel, such as gasoline, for an internal combustion engine, in which the fuel has components including desired combustible hydrocarbon materials and pollutant paramagnetic materials such as water and particulate matter, which is weakly bonded to the combustible hydrocarbon materials.

The apparatus for the magnetic treatment of fuel includes a conduit for conveying the fuel along a portion of a fuel flow path from a fuel source toward the internal combustion engine.

A plurality of magnetic pack means are arranged in succession along at least a portion of the conduit. Each magnetic pack means substantially surrounds one side of the conduit and exposes the fuel, in particular, the paramagnetic materials forming part of the fuel, to a negative magnetic force and then to a positive magnetic force so as to impart a net positive magnetic force to the fuel to polarize and separate the paramagnetic particulate materials from the combustible hydrocarbon molecules in the fuel, to, in turn, facilitate improved combustion of the combustible hydrocarbon molecules.

Each of the magnetic pack means includes at least one magnetic member operably positioned upon one side of the conduit. The magnetic member is oriented so that the fuel flows first past one of the poles of the magnetic member, and then past the other pole of the magnetic member. Each of the magnetic members is a right rectangular prism having three pairs of opposed, substantially parallel extending faces, with the poles arranged in one of the pairs of faces, the pole faces extending substantially perpendicular to the conduit.

Each magnetic pack means also includes at least one external reflector member which is operably arranged adjacent to the magnetic member for focusing the magnetic flux from one of the poles of the magnetic member into the conduit. Each external reflector has a wall section and a base section. The base section is configured to be positioned adjacent to and partially surrounding the conduit, and has a conical groove formed in it. The conical groove forms a sharp, semi-circular edge in the base section which is to be positioned against the conduit to act as a focal position for the adjacent magnetic members.

Each of the magnetic pack means further includes at least one internal reflector member which is operably arranged within the conduit and positioned in substantial alignment with the at least one external reflector to further focus and direct the magnetic flux from the pole of the magnetic member through the fuel. Preferably, each internal reflector member is a right rectangular prism, having a longitudinally-extending W-shaped groove operably disposed thereon.

In a preferred embodiment of the invention, each of the magnetic pack means also includes a first magnetic member having an orientation wherein its north pole faces upstream relative to the fuel flow, and its south pole faces downstream relative to the fuel flow. A first external reflector member, having flux focusing means thereon, is operably positioned immediately adjacent to and downstream from the first magnetic member. A second magnetic member is provided which has an orientation relative to the fuel flow path wherein the south pole faces upstream and the north pole faces downstream, and is positioned adjacent to the first external reflector member, on a side opposite the first magnetic member. A second reflector member, also having flux focusing means, is positioned adjacent to and downstream from the second magnetic member. A third magnetic member is positioned adjacent to the second reflector member, and oriented so that its north pole faces upstream and its south pole faces downstream. A plurality of internal reflector members are arranged within the conduit along the flow path, with the W-shaped grooves extending substantially parallel to the flow path, with each internal reflector member along the direction of fuel flow being angularly displaced around a central axis of the conduit, relative to the immediately preceding internal reflector member. In the preferred embodiment of the invention, each internal reflector member is angularly displaced five degrees around the central axis, relative to the immediately preceding internal reflector member.

The invention additionally includes a core member, which is configured to be insertingly received within the conduit, for supporting the internal reflector members. The core member is to be fabricated from aluminum or similar non-magnetic material.

In the preferred embodiment of the invention, five magnetic packs are used. While permanent magnets, such as ceramic permanent magnets, are preferred, electromagnets could also be employed to provide the magnetic influence. Both the external and internal reflector members are to be fabricated from magnetically conductive material, preferably ferromagnetic material.

The apparatus is also provided with a frame for holding the magnetic packs in the desired orientation to the conduit. The frame is fabricated from a nylon or similar material, to protect and insulate the conduit from external electrostatic effects which may emanate from other components in the internal combustion engine. A further housing, to protect and support the frame, may also be employed. The housing may be fabricated from aluminum.

DETAILED DESCRIPTION OF THE DRAWINGS

Figure 1:
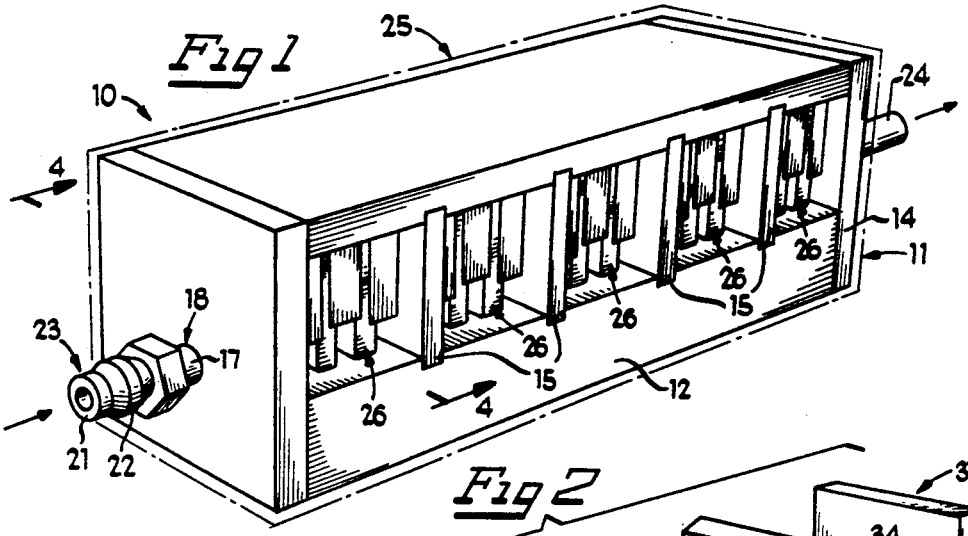
FIG. 1 is a perspective view of the apparatus for magnetic treatment of fuel according to the present invention, partially in section, showing the arrangement of magnetic packs within the housing of the apparatus.

While this invention is susceptible of embodiment in many different forms, there is shown in the drawings and herein will be described in detail, a single embodiment, with the understanding that the present disclosure is to be considered as an exemplification of the principles of the invention and is not intended to limit the invention to the embodiment illustrated.

Fuel treatment apparatus 10 (FIG. 1) is intended to be installed in the fuel line system of an internal combustion engine (not shown) at a position between the fuel tank (not shown) and the carburetor or fuel injectors of the engine (not shown). Fuel treatment apparatus 10 includes frame 11, having base 12, end walls 13 and 14, dividers 15 and top wall 16, all of which, in the preferred embodiment of the invention, are fabricated from nylon, or a similar material, in order to insulate the interior of apparatus 10 from external electrostatic effects which may affect the magnetic fields present within apparatus 10.

Fuel conduit 17 extends completely through frame 11, firstly through aperture 18 in end wall 13. Conduit 17 is embedded, approximately half its diameter, in a lengthwise-extending groove 19 (see FIG. 4) in base 12. Semicircular cutouts (not shown) in dividers 15 accommodate the upper half of conduit 17, which exits frame 11 through an aperture (not shown) in end wall 14, similar to aperture 18 in end wall 13. In order to enable the fuel to be exposed to magnetic influence, conduit 17 is preferably fabricated from a material which is substantially transparent to magnetic force, such as copper.

Figure 3:
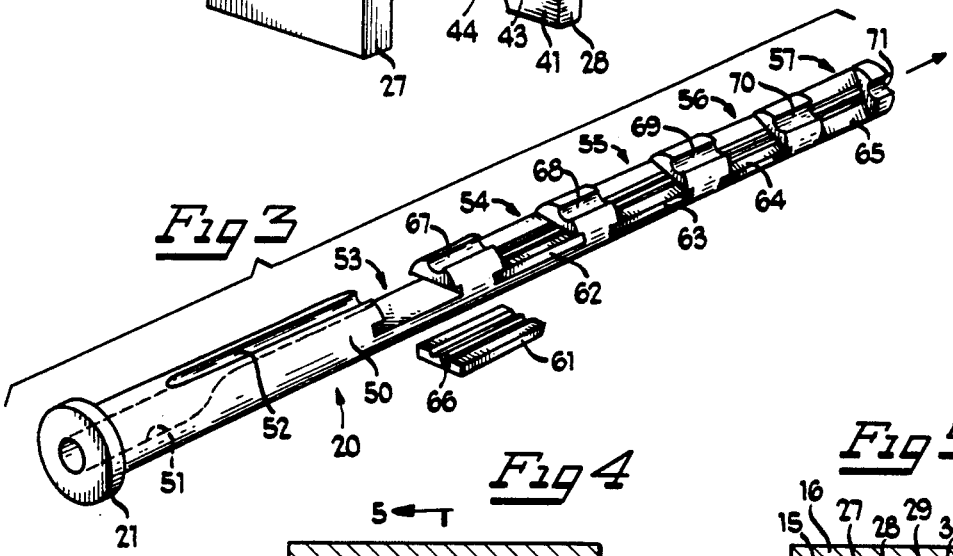
FIG. 3 is a partially exploded perspective view of the core for the fuel conduit, showing the internal reflectors.
Figure 4:
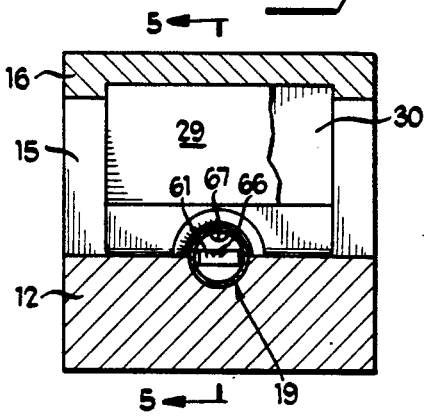
FIG. 4 is a sectional view taken along lines 4—4 of FIG. 1, and looking in the direction of the arrows, perpendicular to the flow of fuel through the apparatus, showing the internal and external reflectors.
Figure 5:
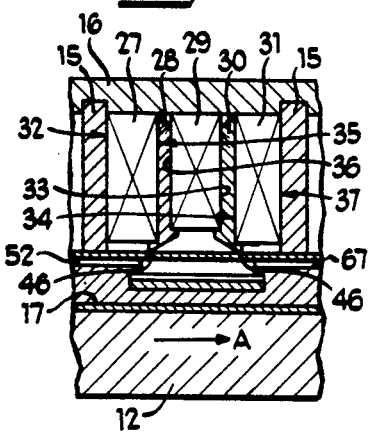
FIG. 5 is a cross-sectional side elevation taken along lines 5—5 of FIG. 4, and looking in the direction of the arrows, of one of the magnetic packs, showing the external reflector edges.

Core 20, as discussed in further detail with respect to FIGS. 3–5, is configured to be insertingly received within conduit 17, preferably with a relatively tight, slightly forced fit. Flange 21 is provided to cooperate with fitting 22 for connecting apparatus 10 to the engine fuel line in a known manner. Fuel enters apparatus 10 from the fuel tank at inlet 23 and exits toward the carburetor or fuel injectors by outlet 24. In the preferred embodiment of the invention, a box-like outer cover 25 (shown in phantom for clarity) is provided to additionally protect apparatus 10.

Dividers 15 substantially separate the interior space of frame 11 into a plurality of separate compartments, five, in the present disclosure, into which magnetic packs 26 are installed. As each magnetic pack 26 is configured to be substantially identical to every other magnetic pack 26, description of a single magnetic pack 26 will be sufficient for understanding of the operation of fuel treatment apparatus 10. Magnetic pack 26 is formed by magnets 27, 29 and 31. A reflector 28 is positioned between magnets 27 and 29, while reflector 30 is positioned between magnets 29 and 31. Magnets 27, 29 and 31 are preferably configured as ceramic permanent magnets, shaped as right rectangular prisms, having their north and south poles disposed in the planes of the largest opposed faces of the prisms, which are arranged to extend perpendicular to conduit 17.

Figure 2:
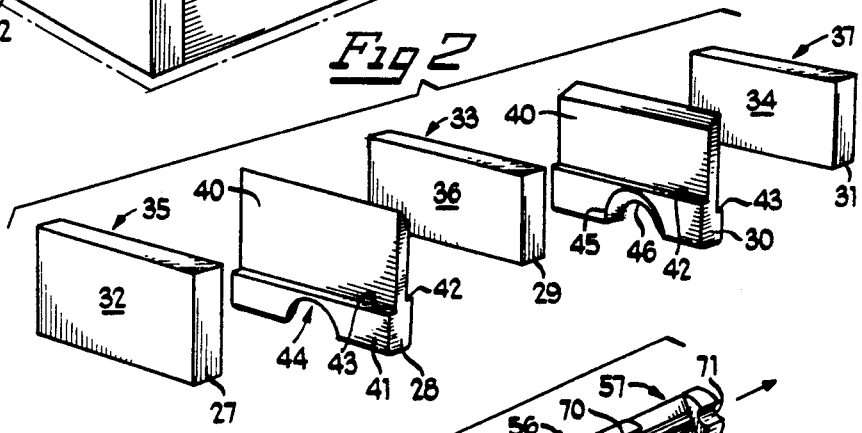
FIG. 2 is an exploded perspective view of one of the magnetic packs of the apparatus, showing the magnetic members and external reflectors.

The orientation of the poles of magnets 27, 29 and 31 substantially affects the establishment of the proper magnetic fields, in order to expose the fuel passing through conduit 17 to a net positive magnetic influence. The flow of fuel past a magnetic pack 26, is indicated by arrow A in FIG. 5. Specifically, magnets 27, 29 and 31 are so oriented that poles 32, 33 and 34 are "north" poles, while poles 35, 36 and 37 are "south" poles. In order to enhance and focus the magnetic forces, reflectors 28 and 30 are provided. As can be seen from FIGS. 2 and 5, reflectors 28 and 30 are substantially identical, but are positioned within pack 26 symmetrically in mirror-image orientation on opposite sides of magnet 29. Reflectors 28 and 30 are formed, in the preferred embodiment of the invention, from ferromagnetic material so as to conduct magnetic force. Each includes vertical wall portion 40, supported by a base 41, which has an upper ledge 42 and a lower ledge 43. Arch 44, which is formed in base 41, is shaped as a conical groove, with an outer edge 45 and a sharply cornered inner edge 46. Edges 46 serve as focus points of the magnetic flux which emanates from the adjacent poles of magnets 27 and 29, and 29 and 31, which abut against vertical walls 40, of reflectors 28 and 30, such that edges 46 of reflectors 28 and 30 become focused south and north poles, respectively.

Core 20 is provided to direct the flow of fuel through conduit 17 past magnetic packs 26 in a particular desired manner. Specifically, core 20, as seen in FIG. 3, is provided with a main shaft portion 50, which is generally cylindrical and has a diameter only slightly less than the interior diameter of conduit 17 so that core 20 can be inserted into conduit 17 with a slightly forced fit. A bore 51, which opens onto the upstream end of core 20, extends co-axially and concentrically with main shaft portion 50 for a short distance and then turns, at an oblique angle, toward the outer surface of shaft 50, opening onto a shallow concave trough 52 formed into the outer surface. At regularly spaced intervals along shaft 50, notches 53–57 are formed. Notches 53–57 are positioned along the length of shaft 50 such that when shaft 50 is inserted into conduit 20, notches 53–57 are substantially in axial registry with magnetic packs 26. Notches 53–57 are advantageously configured so as to insertingly receive internal reflector bodies 61–65, respectively.

Internal reflector bodies 61–65 are substantially identical to one another. Internal reflector body 61, for example, is preferably fabricated from ferromagnetic metal, substantially identical to the material used to form external reflectors 28 and 30. Internal reflector body 61 is formed as a substantially flat right rectangular prism having a W-shaped groove 66 longitudinally formed therein so as to extend parallel to shaft 50. Internal reflector bodies 61–65 are configured to be easily inserted into respective notches 53–57, and each has a width which is sufficiently narrow to permit insertion of shaft 50 into conduit 20. Once inserted, the clearance at the sides of each of internal reflector bodies 61–65 is sufficiently small to prevent significant side-to-side movement of internal reflector bodies 61–65, relative to conduit 20. It is believed that the configuration of external reflectors 28, 30, and internal reflectors, such as reflector 61, achieves the most effective concentration and focusing of the magnetic flux, generated by the magnets, through conduit 17 and into the fuel passing through, that has yet been obtained.

Trough 52 is continued in alternating fashion with notches 53–57, as interrupted troughs 67–71, such that when shaft 50 is inserted into conduit 20, the fuel is substantially constrained to flow through bore 51, along trough 52, over reflector body 61, along trough 67, over reflector body 62, and so on, through to trough 71, and out through outlet 24.

It is known that the pressure and speed of fuel pumps for internal combustion engines, such as automobile engines, varies from model to model. Accordingly, such a variance in fuel flow can affect the amount of exposure to magnetic influence the fuel can get while passing through apparatus 10. In order to obtain the maximum exposure of the fuel to the magnetic influence of magnetic packs 26, the magnetic flux from each pack 26 is to be focused through conduit 20 in a slightly different direction, with respect to the packs immediately preceding and following each particular pack. This is accomplished by forming notches 53–57 in such a way that, for example, internal reflector 62 is rotated around the longitudinal axis of shaft 50 approximately 5 degrees clockwise, as viewed from inlet end 23 of shaft 50, with respect to internal reflector 61. Similarly, internal reflector 63 is axially rotated a further 5 degrees relative to internal reflector 62, and so on. The portions of shaft 50, in which interrupted troughs 67–71 are formed, are likewise rotated, in order to physically accommodate the notches 53–57. The rotation of interrupted troughs 67–71 also helps to keep the main flow of fuel substantially centered over internal reflectors 61–65.

The operation of the gas treatment apparatus 10 is as follows. Gas treatment apparatus 10 is installed in a vehicle fuel line, for example between the fuel pump and the fuel intake, carburetor or the like. As an optimum condition, it is desirable if the flow into fuel treatment apparatus 10 is turbulent, to further facilitate greater exposure of the fuel to magnetic influence. The fuel enters apparatus 10 via bore 51 of conduit 20 at inlet 23. As the fuel passes along core 20, it passes through the magnetic fields established in each of the magnetic packs 26. In each magnetic pack 26, the fuel is exposed first to a negative and then a positive magnetic influence as the fuel passes the south and north poles, successively, situated at the edges 46 of reflectors 28 and 30. As the fuel passes each magnetic pack 26, and as it exits apparatus 10, it has been exposed to an overall net positive magnetic influence. It is believed that the effect of the magnetic field, in particular, the net overall positive magnetic influence, is to polarize the paramagnetic particles within the liquid, relative to the hydrocarbon fuel molecules, so as to unbond the paramagnetic particles, in particular, the water molecules, from the hydrocarbon molecules of the fuel. In addition, it has been empirically observed that there appear to be microscopic bubbles forming in the fuel. These microscopic bubbles are believed to be the result of the formation of gaseous free oxygen ($O_2$) which was previously dissolved in the liquid fuel. Alternatively, it is possible that the exposure to the magnetic force actually accomplishes the breaking apart of the water molecules in the fuel to release hydrogen and oxygen. It is not believed that the net positive magnetic influence has any direct effect upon the gasoline hydrocarbon fuel molecules themselves.

It has been observed, that upon use of the fuel treatment apparatus 10, the quality of the exhaust gases generated by the internal combustion engine is improved, relative to the gases produced by an unmodified engine. Most particularly, the percentage of unburned or incompletely burned hydrocarbons are reduced. Accordingly pollutant emissions are reduced and, due to the more efficient burning of the fuel, engine efficiency, in terms of mileage per gallon of fuel, is also improved.

While the embodiment which is shown is believed to be the present preferred embodiment, certain variations may be made in the configuration of the apparatus without departing from the scope of the invention. For example, the apparatus is shown as having five magnetic packs 26. This is a practical consideration arising from the need and benefit of greater exposure to positive magnetic influence in the environment of gasoline type fuel. However, a greater number of magnetic packs 26 may be added, subject to the considerations of available space, and impact upon engine fuel flow requirements. In the present embodiment of the invention, the use of permanent magnets, in particular ceramic magnets, is shown. It has been determined that through the use of available permanent magnets together with the advantageous use of reflectors as shown in the present embodiment, magnetic field strengths on the order of 21,000 gauss can be obtained. However, it is possible that electromagnets might also be used instead of permanent magnets.

The foregoing description and drawings merely explain and illustrate the invention and the invention is not limited thereto except insofar as the appended claims have been so limited, as those skilled in the art who have the disclosure before them will be able to make modifications and variations therein without departing from the scope of the invention.

What is claimed is:

1. An apparatus for the magnetic treatment of fuel such as gasoline, for an internal combustion engine, said fuel having as components thereof desired combustible hydrocarbon materials and undesired paramagnetic materials such as water and particulate matter weakly bonded to said desired combustible hydrocarbon materials, said apparatus for the magnetic treatment of fuel comprising:

a conduit for conveying said fuel along a fuel flow path toward said internal combustion engine;

a plurality of magnetic pack means, arranged in succession, along at least a portion of said conduit, each magnetic pack means substantially surrounding said conduit for exposing said fuel, and, in particular, said paramagnetic materials intermixed into said fuel, to a negative magnetic force and subsequently to a positive magnetic force, so as to impose a net positive charge onto said paramagnetic materials to unbond said paramagnetic materials from said desired combustible hydrocarbon materials, to, in turn, facilitate more complete combustion of said desired combustible hydrocarbon materials, each of said magnetic pack means including at least one magnetic member operably positioned upon one side of said conduit, said magnetic member being oriented so that said fuel flows first past one of the poles of said magnetic member, and then past the other pole of said magnetic member, each of said magnetic pack means further including at least one external reflector member operably arranged adjacent to said magnetic member for focusing the magnetic flux from one of the poles of the magnetic member into said conduit, each of said magnetic pack means further including at least one internal reflector member operably arranged within said conduit and positioned in substantial alignment with said at least one external reflector to further focus and direct said magnetic flux from said pole of said magnetic member through said fuel.

2. The apparatus for the magnetic treatment of fuel according to claim 1 wherein each of said magnetic pack means further comprises:

a first magnetic member having an orientation relative to said fuel flow path wherein its north pole is upstream and its south pole is downstream;

a first external reflector member, having flux focusing means arranged thereon, operably positioned immediately adjacent to and downstream from said first magnetic member;

a second magnetic member having an orientation relative to said fuel flow path wherein its south pole is upstream and its north pole is downstream;

a second external reflector member, having flux focusing means arranged thereon, operably positioned immediately adjacent to and downstream from said second magnetic member;

a third magnetic member operably positioned immediately adjacent to and downstream from said second external reflector member;

at least a first internal reflector member operably positioned within said conduit and substantially aligned with at least one of said first and second external reflector members.

3. The apparatus for the magnetic treatment of fuel according to claim 1 wherein a plurality of internal reflector members are arranged within said conduit along said flow path, and each successive internal reflector member, along the direction of fuel flow, is angularly displaced around said central axis, relative to the immediately preceding internal reflector member.

4. The apparatus for the magnetic treatment of fuel according to claim 3, wherein each internal reflector member is angularly displaced five degrees around said central axis, relative to the immediately preceding internal reflector member.

5. The apparatus for the magnetic treatment of fuel according to claim 3, further comprising a core member, operably configured to be insertingly received within said conduit, for supporting said internal reflector members within said conduit.

6. The apparatus for the magnetic treatment of fuel according to claim 5, wherein said core member is fabricated from aluminum or similar non-magnetic material.

7. The apparatus for the magnetic treatment of fuel according to claim 1, wherein the plurality of magnetic pack means comprises five magnetic pack means.

8. The apparatus for the magnetic treatment of fuel according to claim 1, wherein each magnetic member is a permanent magnet.

9. The apparatus for the magnetic treatment of fuel according to claim 1, wherein each magnetic member is an electromagnet.

10. The apparatus for the magnetic treatment of fuel according to claim 1, wherein each magnetic member comprises a right rectangular prism, having three pairs of opposed, substantially parallel extending faces, and having its poles operably and substantially arranged in one of said pairs of said faces, said faces extending substantially perpendicular to said conduit.

11. The apparatus for the magnetic treatment of fuel according to claim 1, wherein each external reflector member is fabricated from magnetically conductive material.

12. The apparatus for the magnetic treatment of fuel according to claim 1, wherein each internal reflector member is fabricated from magnetically conductive material.

13. The apparatus for the magnetic treatment of fuel according to claim 1, wherein each external reflector member comprises:

a reflector body having a wall section and a base section;

said base section being configured to be positioned adjacent to and partially surrounding said conduit and having a conical groove formed therein, said conical groove forming a sharp, semi-circular edge in said base section, to be positioned against said conduit to act as a focal position for said at least one magnetic member.

14. The apparatus for the magnetic treatment of fuel according to claim 3 wherein each internal reflector member comprises:

a substantially right rectangular prism, having a longitudinally-extending W-shaped groove operably disposed thereon, such that when said internal reflector member is positioned within said conduit, said W-shaped groove extends substantially parallel to said conduit.

15. The apparatus for the magnetic treatment of fuel according to claim 1 further comprising:

frame means for supporting said at least one magnetic pack means in said arrangement along said portion of said conduit.

* * * * *

UNITED STATES PATENT AND TRADEMARK OFFICE

CERTIFICATE OF CORRECTION

PATENT NO. : 5,243,946

DATED : September 14, 1993

INVENTOR(S) : Romulo V. Dalupan

It is certified that error appears in the above-identified patent and that said Letters Patent is hereby corrected as shown below:

| | |
|---|---|
| Col. 2, line 59 | Delete "imposed" and insert instead -- impose --. |
| Col. 3, line 35 | After "is", insert -- a --. |
| Col. 3, line 35 | After "provide", delete "a" and insert instead -- an --. |

Signed and Sealed this

Third Day of May, 1994

Bruce Lehman

*Attest:*

BRUCE LEHMAN

*Attesting Officer*

*Commissioner of Patents and Trademarks*